US005529724A

United States Patent [19]

Falk

[11] Patent Number: 5,529,724

[45] Date of Patent: Jun. 25, 1996

[54] STRUCTURED LIQUID COMPOSITIONS COMPRISING SELECTED SECONDARY ALCOHOL SULFATES AND A DEFLOCCULATING POLYMER

[75] Inventor: Nancy A. Falk, Lyndhurst, N.J.

[73] Assignee: Lever Brothers Company, Division of Conopco, Inc., New York, N.Y.

[21] Appl. No.: 384,169

[22] Filed: Feb. 6, 1995

[51] Int. Cl.[6] ..... C11D 1/14; C11D 1/22

[52] U.S. Cl. ..... 252/550; 252/174; 252/173; 252/174.18; 252/174.21; 252/174.23; 252/174.24; 252/DIG. 2; 252/DIG. 14

[58] Field of Search ..... 252/173, 174, 252/174.15, 174.17, 174.18, 174.21, 174.23, 549, 550

[56] References Cited

U.S. PATENT DOCUMENTS

| | | | |
|---|---|---|---|
| 4,052,342 | 10/1977 | Fernley et al. | 252/541 |
| 4,079,020 | 3/1978 | Mills et al. . | |
| 4,235,752 | 11/1980 | Rossall et al. | 252/550 |
| 5,075,041 | 12/1991 | Lutz | 252/548 |
| 5,147,576 | 9/1992 | Montague et al. | 252/174 |
| 5,147,578 | 9/1992 | Montague et al. | 252/549 |
| 5,364,553 | 11/1994 | Cao | 252/174.12 |

FOREIGN PATENT DOCUMENTS

91/16409 10/1991 WIPO .

*Primary Examiner*—Margaret Einsmann
*Assistant Examiner*—Necholus Ogden
*Attorney, Agent, or Firm*—Ronald A. Koatz

[57] ABSTRACT

The present invention relates to aqueous surfactant liquid compositions in which it has been found that, if levels of 2 or 3 SALS isomer are kept within a defined window, enhanced performance and stability benefits are realized.

6 Claims, 4 Drawing Sheets

40% actives
5% glycerol
3.5% borate
10% citrate
K+/Na+=1
1.5% dcp

40% actives
5% glycerol
3.5% borate
10% citrate
K+/Na+=1
1.5% dcp
phi-lam/viscosity
@ 25 C & 21s-1
FREEZING
PHS. SEP'N
OLEIC ACID
0.941/PASTE
PASTE
0.767/4098
0.685/1799
0.859/4500
0.703/PASTE
0.814/PASTE
0.838/10870
0.717/426
0.864/900
0.748/1084
PASTE
PASTE
PASTE
PASTE
SALS (FROM
DAN 216)
NEODOL
23-6.5

STRUCTURED LIQUID COMPOSITIONS COMPRISING SELECTED SECONDARY ALCOHOL SULFATES AND A DEFLOCCULATING POLYMER

BACKGROUND OF THE INVENTION

1. Field of the Invention

The present invention to aqueous, structured compositions (i.e., duotropic liquids) containing secondary alcohol sulfate (SALS). More particularly, aqueous, structured compositions comprising defined levels of SALS having a specified isomeric distribution yield enhanced performance and stability benefits relative to amounts and types of secondary alcohol sulfates falling outside the scope of the invention.

2. Related Art

The use of alcohol sulfates generally in aqueous structured compositions is known, for example, from U.S. Pat. No. 5,147,576 to Montague et al. While this reference does not exclude the use of secondary alcohol sulfates, nor does it specifically identify the compounds, let alone their use in critical amounts and in critical isomer distribution (i.e., minimal levels of total secondary alcohol sulfate must be 2 or 3 isomer).

WO 91/16409 to Donker also discloses the use of primary alcohol sulfates in structured liquids (i.e., duotropic liquids). Secondary alcohol sulfates are not disclosed. In addition, the application specifies that at least 20% of the primary alcohol sulfate should be branched.

U.S. Pat. No. 4,235,752 to Rossall discloses hand dishwashing liquids containing up to 50% 2,3 isomer of secondary alcohol sulfate. This reference relates to use of secondary alcohol sulfate in an isotropic (i.e., non-structured) composition. As such, the benefits of the secondary alcohol sulfate of the invention in duotropic, structured liquids could not possibly be appreciated and there would have been no motivation to use these sulfates in the structured liquids.

BRIEF SUMMARY OF THE INVENTION

The present invention is concerned with the use of specific amounts of specific isomers of secondary alcohol sulfate (i.e., 2 or 3 isomers) in structured liquids. Unexpectedly, applicants have recognized that, if greater than about 35 to about 85%, preferably about 50% to about 70%, total secondary alcohol sulfate used in the structured liquids is 2 and/or 3 isomers of secondary alcohol sulfate, good performance and stability benefits are achieved (comparable to use of primary alcohol sulfates). When amounts of the 2 and/or 3 isomers outside this range are used, performance and/or stability problems are found.

The compositions preferably comprise a ternary system comprising 1:2 to 2:1, preferably about 1:1 ratio of anionic to nonionic wherein the anionic comprises $C_{14}$ to $C_{18}$ monounsaturated fatty acid and SALS, wherein about 35% to 85% of the total SALS is 2 and/or 3 isomer. The compositions also preferably comprise a decoupling or deflocculating polymer comprising about 1.5% to about 5% of the composition and the compositions further preferably comprise about 1 to 35% by weight salting and electrolyte. The compositions may optionally comprise 1 to 25% by weight zeolite.

DETAILED SUMMARY OF THE INVENTION

Figure 1:
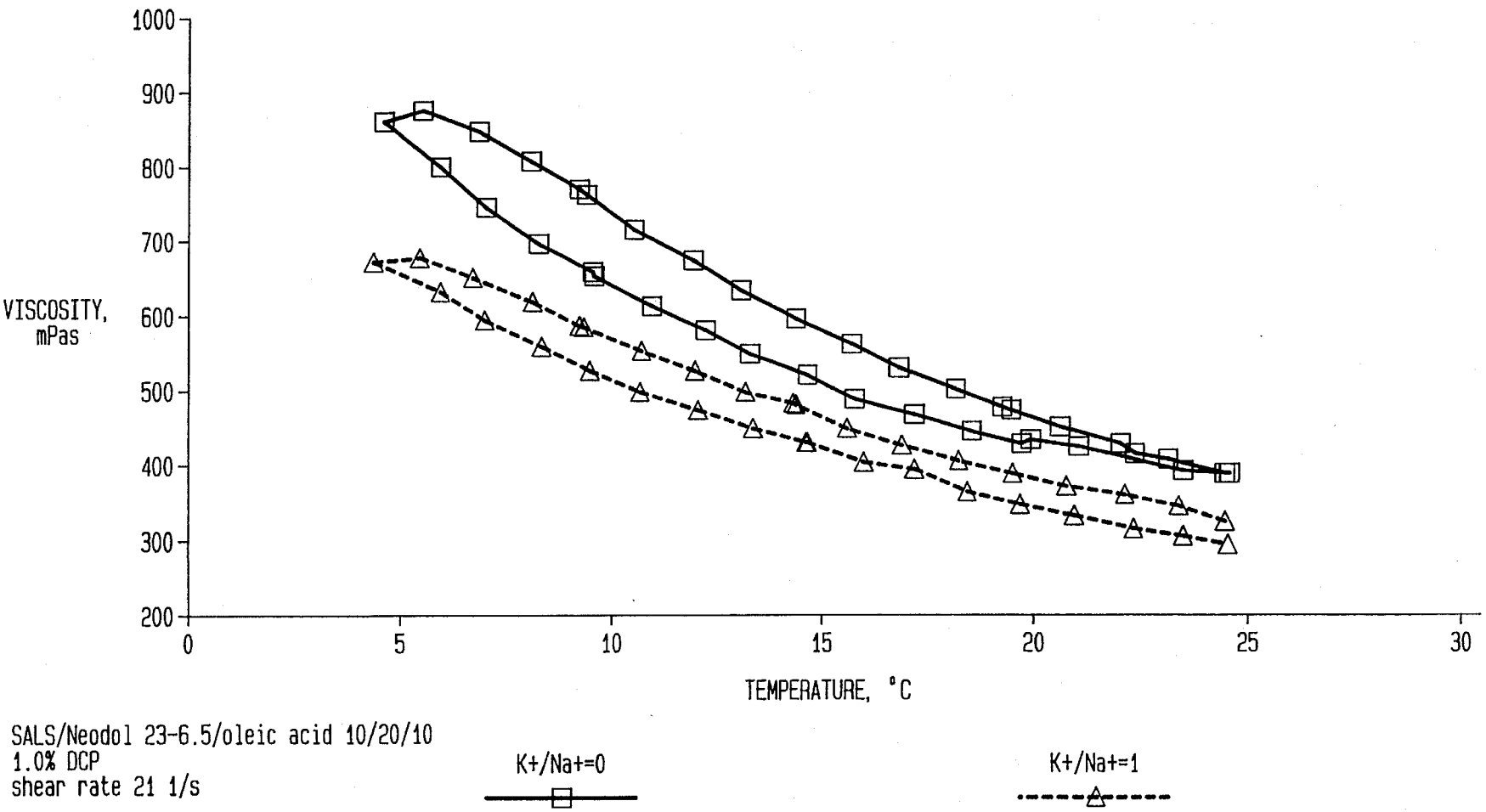
FIG. 1 shows relationship of viscosity and temperature for HDL formulations comprising SALS at 62% 2 or 3 isomer level.

The present invention comprises duotropic, lamellar compositions comprising (1) about 1 to 30% nonionic surfactant and (2) about 1 to 40% anionic wherein the anionic comprises (a) about 1 to 20% $C_{14}$ to $C_{18}$ monounsaturated fatty acid and (b) SALS, wherein the isomer distribution of the SALS is such that 35 to 85% of the total SALS is 2 or 3 isomer. The ratio of anionic to nonionic is about 1:2 to 2:1, preferably about 1:1 and, preferably, the compositions comprises about 1.5% to about 5% deflocculating or decoupling polymer.

The present invention is concerned with liquid detergent compositions of the kind in which particles of solid material can be suspended by a structure formed from detergent active material, the active structure existing as a separate phase dispersed within predominantly aqueous phase. This aqueous phase contains dissolved electrolyte.

Three common product forms of this type are liquids for heavy duty fabrics washing and liquid abrasive and general purpose cleaners. In the first class, the suspended solid can be substantially the same as the dissolved electrolyte, being an excess of same beyond the solubility limit. This solid is usually present as a detergency builder, i.e., to counteract the effects of calcium ion water hardness in the wash. In addition, it may be desirable to suspend substantially insoluble particles of bleach, for example diperoxydodecanoic acid (DPDA). In the second class, the suspended solid is usually a particulate abrasive, insoluble in the system. In that case the electrolyte is a different, water soluble material, present to contribute to structuring of the active material in the dispersed phase. In certain, cases, the abrasive can however comprise partially soluble salts which dissolve when the product is diluted. In the third class, the structure is usually used for thickening products to give consumer-preferred flow properties, and sometimes to suspend pigment particles. Compositions of the first kind are described, for example in our patent specification EP-A-38,101 while examples of those in the second category are described in our specification EP-A-140,452. Those in the third category are, for example, in U.S. Pat. No. 4,244,840.

The dispersed structuring phase in these liquids is generally believed to consist of an onion-like configuration comprising concentric bilayers of detergent active molecules, between which is trapped water (aqueous phase). These configurations of active material are sometimes referred to as lamellar droplets. It is believed that the close-packing of these droplets enables the solid materials to be kept in suspension. The lamellar droplets are themselves a sub-set of lamellar structures which are capable of being formed in detergent active/aqueous electrolyte systems. Lamellar systems in general, are a category of structures which can exist in detergent liquids. The degree of ordering of these structures, from simple spherical micelles, through disc and rod-shaped micelles to lamellar droplets and beyond progresses with increasing concentrations of the actives and electrolyte, as is well known, for example from the reference H A. Barnes, 'Detergents' Ch. 2 in K. Walters (Ed.), 'Rheometry: Industrial Applications', J. Wiley & Sons, Letchworth 1980. The present invention is concerned with all such structured systems which are capable of suspending particulate solids, but especially those of the lamellar droplet kind.

Generally, the composition comprises at least 15% by wt. detergent active material and from 1 to 35% by wt., preferably 1 to 30% by wt. salting out electrolyte.

In general, the detergent active material most preferably constitutes at least 20% by weight of the total composition, especially at least 25%, and in any event may be selected from one or more of anionic, cationic, nonionic, zwitterionic and amphoteric surfactants, provided the material forms a structuring system in the liquid. Most preferably, the detergent active material comprises (a) a non ionic surfactant and/or a polyalkoxylated anionic surfactant; and (b) a non-polyalkoxylated anionic surfactant.

Suitable nonionic surfactants which may be used include in particular the reaction products of compounds having a hydrophobic group and a reactive hydrogen atom, for example aliphatic alcohols, acids, amides or alkyl phenols with alkylene oxides, especially ethylene oxide either alone or with propylene oxide. Specific nonionic detergent compounds are alkyl ($C_6$–$C_{22}$) phenols-ethylene oxide condensates, the condensation products of aliphatic ($C_8$–$C_{18}$) primary or secondary linear or branched alcohols with ethylene oxide, and products made by condensation of ethylene oxide with the reaction products of propylene oxide and ethylenediamine. Other so-called nonionic detergent compounds include long chain tertiary amine oxides, long chain tertiary amine oxides, long chain tertiary phosphine oxides and dialkyl sulphoxides. Sugar nonionic surfactants are also contemplated by the invention. These include aldobionamide surfactants disclosed in U.S. Ser. No. 981,737 and the hydroxy fatty acid amides disclosed, for example, in U.S. Pat. No. 5,312,934 to Letton, both of which are hereby incorporated by reference into the subject application.

As for anionic actives, because of certain processing difficulties which may be encountered using primary alcohol sulfates (PAS) as the anionic, it has been thought desirable to seek alternative anionics. According to the present invention, when one such anionic, i.e., SALS (secondary alcohol sulfate) is used in a particular isomer distribution, a critical window is found (i.e., about 35% to 85% by molar distribution of 2 and/or 3 SALS of total SALS) in which enhanced stability is found.

Preferably, a $C_{14}$ to $C_{18}$ monounsaturated fatty acid which is, for example, oleate helps enhance stability of SALS in such duotropic liquids even further. Other acids include palmitoleic acid and linoleic acid. This acid should be used in an amount below about 20% by wt. of total composition, preferably 1 to 19% by wt. of the composition.

The compositions also contain a salting-out electrolyte (e.g., sodium, sulfate or citrate). This has the meaning ascribed to it in specification EP-A-79,646. Optionally, some salting-in electrolyte (as defined in the latter specification) may also be included, provided if of a kind and in an amount compatible with the other components and the composition is still in accordance with the definition of the invention claimed herein. Some or all of the electrolyte (whether salting-in or salting-out) may have detergency builder properties. In any event, it is preferred that compositions according to the present invention include detergency builder material, some or all of which may be electrolyte. The builder material is any capable of reducing the level of free calcium ions in the wash liquor and will preferably provide the composition with other beneficial properties such as the generation of an alkaline pH, the suspension of soil removed from the fabric and the dispersion of the fabric softening clay material.

Examples of phosphorus-containing inorganic detergency builders, when present, include the water-soluble salts, especially alkali metalpyrophosphates, orthophosphates, polyphosphates and phosphonates. Specific examples of inorganic phosphate builders include sodium and potassium tripolyphosphates, phosphates and hexametaphosphates.

Examples of non-phosphorus-containing inorganic detergency builders, when present, include water-soluble alkali metal carbonates, bicarbonates, silicates and crystalline and amorphous alumino silicates. Specific example include sodium carbonate (with or without calcite seeds), potassium carbonate, sodium and potassium bicarbonates, silicates and zeolites.

Examples of organic detergency builders, when present, include the alkaline metal, ammonium and substituted ammonium polyacetates, carboxylates, polycarboxylates, polyacetyl carboxylates and polyhydroxy sulphonates. Specific examples include sodium, potassium, lithium, ammonium and substituted ammonium salts of ethylenediaminetetraacetic acid, nitrilotriacetic acid, oxydisuccinic acid, melitic acid, benzene polycarboxylic acids and citric acid.

Apart from the ingredients already mentioned, a number of optional ingredients may also be present, for example lather boosters such as alkanolamides, particularly the monoethanolamides derived from palm kernel fatty acids and coconut fatty acids, lather depressants, oxygen-releasing bleaching agents such as sodium perborate and sodium percarbonate, peracid bleach precursors, chlorine-releasing bleaching agents such as tricloroisocyanuric acid, inorganic salts such as sodium sulphate, and, usually present in very minor amounts, fluorescent agents, perfumes, enzymes (such as proteases amylases, lipases and cellulases), germicides and colorants.

Preferably, the compositions of the invention should also contain about 1.5% to about 5% by wt. of a deflocculating polymer such as described in U.S. Pat. No. 5,147,576 to Montague et al., hereby incorporated by reference into the subject application.

The invention will now be further set forth by the following examples. The examples are for illustrative purposes only and are not intended to be limiting in any way.

EXPERIMENTAL METHODS

Materials Used

Secondary alcohol sulfates and $C_{12}$–$C_{13}$ alcohol ethoxylates (average number of ethylene oxide units per molecule= 6.5) were provided by Shell Chemical Company. The deflocculating polymer used (acrylate/lauryl methacrylate co-polymer (25:1 monomer ratio), MW approximately 3800) was obtained from National Starch and Chemical Company. All other materials were used as obtained from Fisher Chemical Company. Ingredients of the formulations stated are set forth in Table 1 below. Unless otherwise stated, the ratio of sodium to potassium ions was 1:1.

TABLE 1

| SALS Formulation Ingredients | |
|---|---|
| Ingredient | Wt. % |
| SALS | 40 (Total Actives) |
| Neodol 23-6.5 | |
| Oleic Acid | |
| KOH | Varies |
| NaOH | Varies |
| Citric Acid (Anhyd.) | 6.5 |
| Glycerol | 5.0 |
| Sodium Borate. 10 aq | 3.5 |
| Sodium Sulfate | 2.0 |
| Narlex DC-1* | 1.0 or 1.5% |
| Water | to 100% |

*Deflocculating Polymer

Processing Technique

All formulations in the examples followed the same order of addition. First, the electrolyte is prepared by dissolving citric acid (or sodium citrate), boric acid (or sodium borate), glycerol, sodium sulfate, and the alkali metal hydroxides in water. The deflocculating polymer is added next. The surfactants (secondary alcohol sulfates, alcohol ethoxylate, and oleic acid) are then added. The formulation is then mixed with a Tekmar RW20DZM overhead mixer, equipped with a 35 mm diameter four-blade impeller, for 30 minutes at a constant temperature of 40° C.

Evaluation Techniques

The pH of all formulations was measured with a Corning 240 pH meter, calibrated with pH 7 and pH 10 buffer solutions. Formulation pH values ranged from 9.5 to 11.5, depending upon the pH of the surfactant samples used.

Formulations were centrifuged for 30 minutes at 15,000–20,000 rpm on Sorvall or IEC ultra centrifuges. Centrifuged formulations were inspected to determine if more than one surfactant-rich phase was present.

Viscosities of formulations were measured on a Haake RV20 concentric-cylinder rotoviscometer (M5 measuring system, MV rotor and beaker). The temperature was held at 25° C. for 10 minutes, then decreased linearly by 0.5° C. per minute until 5° C. was reached, then increased at the same rate until 25° C. was reached. A constant shear rate of 21 $s^{-1}$ was used. A formulation was judged to have "frozen" if sudden large increases in viscosity or slip of the formulation was visible (indicated by less of formulation contact with viscometer spindle) during the run.

Formulations that did not "freeze" after this test were refrigerated for 2–3 days at 5° C. The formulation was then observed visually for pourability. The viscosity of the formulation was then measured at 5° C. on the aforementioned Haake viscometer for 30 minutes. The formulations were also observed under polarized light microscopy to determine formulation microstructure. If multi-lamellar droplets typical of duotropic liquids are present, Maltese crosses appear.

Stability of formulations was determined by storage in nongraduated glass cylinders at room temperature over several weeks. If phase separation occurred in less than two weeks, this is noted on phase diagrams.

The conductivities of both the formulation and a simulated continuous phase (comprising water added, water of neutralization, citrate, sulfate, borate, and glycerol or propylene glycol; the sodium to potassium ratio is consistent with that for the formulation) were measured on a Radiometer Copenhagen CDM-83 conductivity meter calibrated for the appropriate conductivity range. From this information and an estimated lamellar phase conductivity of 0.8 mS/cm, the Bruggeman equation (J. c. van de Pas, *Tenside Surf. Det.*, 28, 158 (1991)) was used to calculate the lamellar phase volume fraction for some of the formulations.

EXAMPLES

Example 1

Formulation compositions are as in Table 1, specifically containing 5% propylene glycol, 3.5% sodium borate decahydrate, 6.5% citric acid (anhydrous), 8.9% potassium hydroxide, 2.6% sodium hydroxide, 1.5% deflocculating polymer, 10% secondary alcohol sulfate, 20% $C_{12}$–$C_{13}$ alcohol ethoxylate (average number of ethylene oxide units 6.5), 10% oleate, balance water. Sodium/potassium ratio for all liquids=1.0.

All liquids were stored for 2–3 days at 5° C.; the viscosities were then measured at 21 $s^{-1}$ and 5° C. for 30 minutes. The viscosities below in Table 2 are the average viscosities over the time of the run.

TABLE 2

| Viscosities at 21 $s^{-1}$ and 5° C. as a function of 2 & 3 isomer content | |
|---|---|
| % 2 & 3 isomer | Viscosity @ 21 $s^{-1}$ and 5° C. [mPas], remarks |
| 22 | did not measure; two active phases |
| 38 | 1274, pourable |
| 51 | 1494, pourable |
| 64 | 2111, pourable |
| 81 | 2962, pourable |
| 100 | 3038, pourable only after stirring (highly viscous skin formed on top of formulation during storage) |

This example indicates that too low a level (i.e., 22%) of combined 2 & 3 isomers gives an unstable lamellar phase, but too high a level (100%) of these isomers gives a liquid that gives unsuitable cold storage stability.

Example 2

Figure 2:
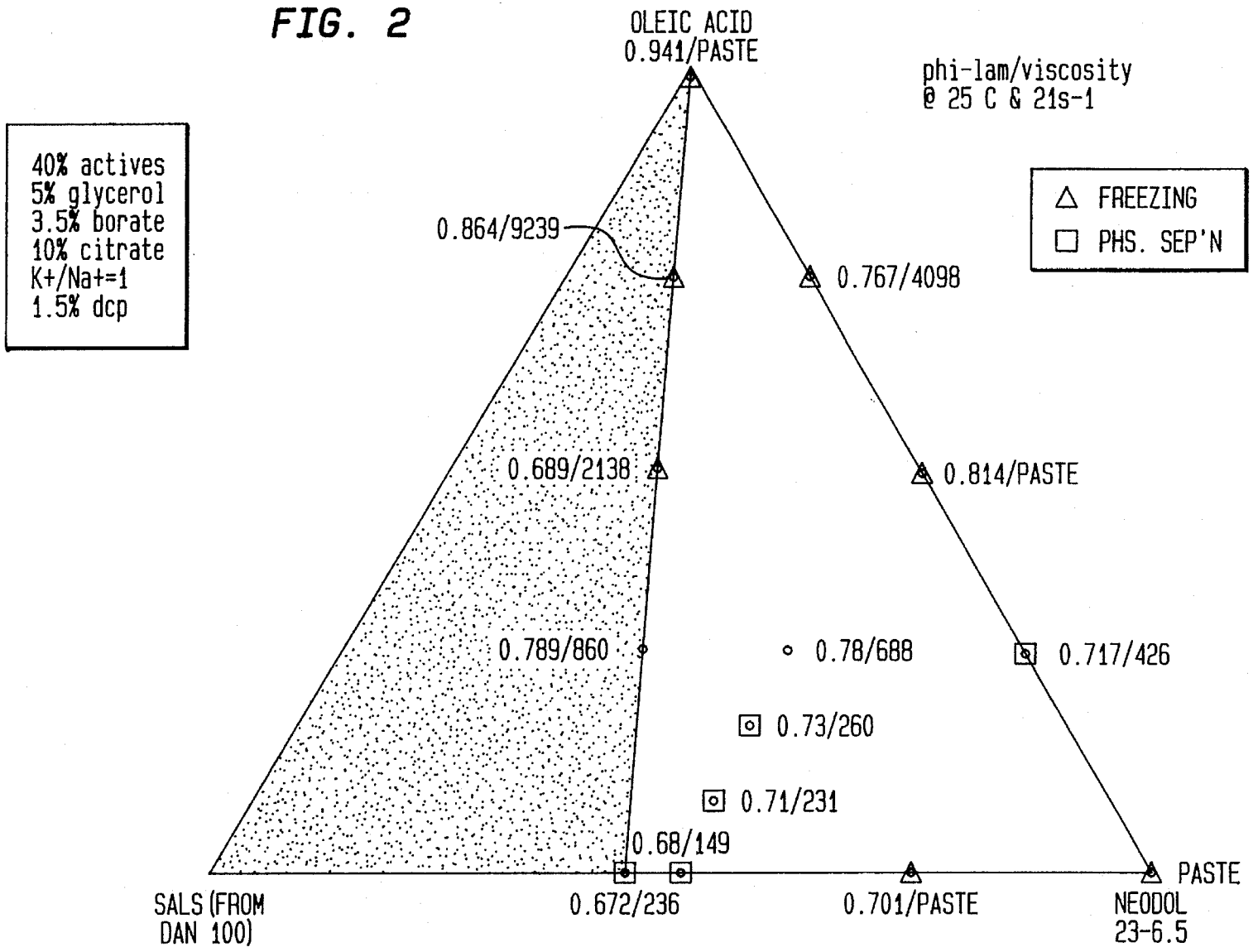
FIG. 2 is a ternary phase diagram for DAN 100 (2 or 3 isomer distribution of 62% within invention) with oleate and Neodol 23-6.5 ($C_{12}$–$C_{13}$ alcohol ethoxylate with average 6.5 ethoxylation units). This figure shows that some monounsaturated fatty acid is required for stability, but that the level of acid should not be too high.
Figure 3:
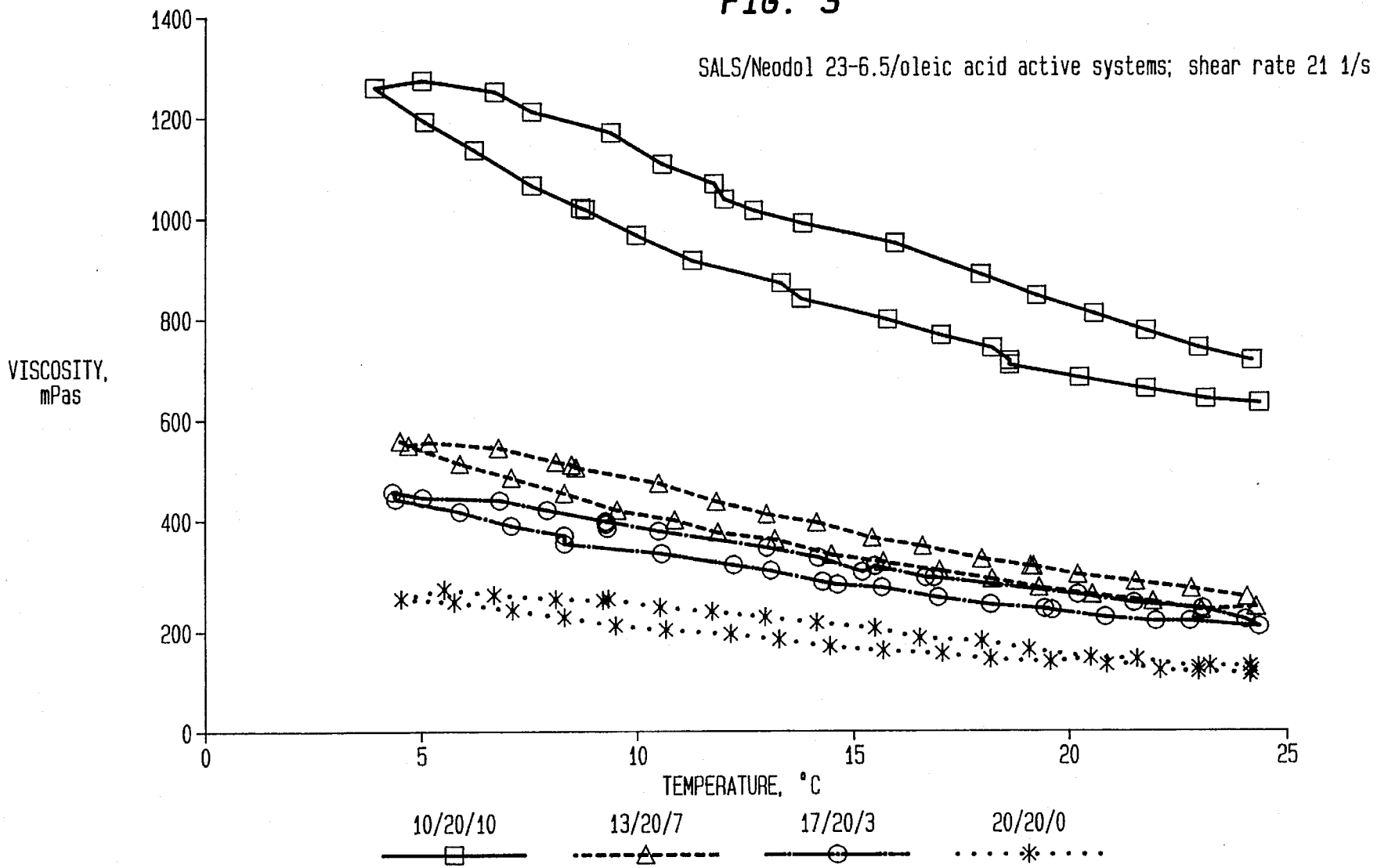
FIG. 3 is a viscosity/temperature profile at 21 $s^{-1}$ for four DAN 100 formulations with 20% nonionic and 20% active split between SALS and oleate. This figure again shows that some, but not too much, monounsaturated fatty acid is required.
Figure 4:
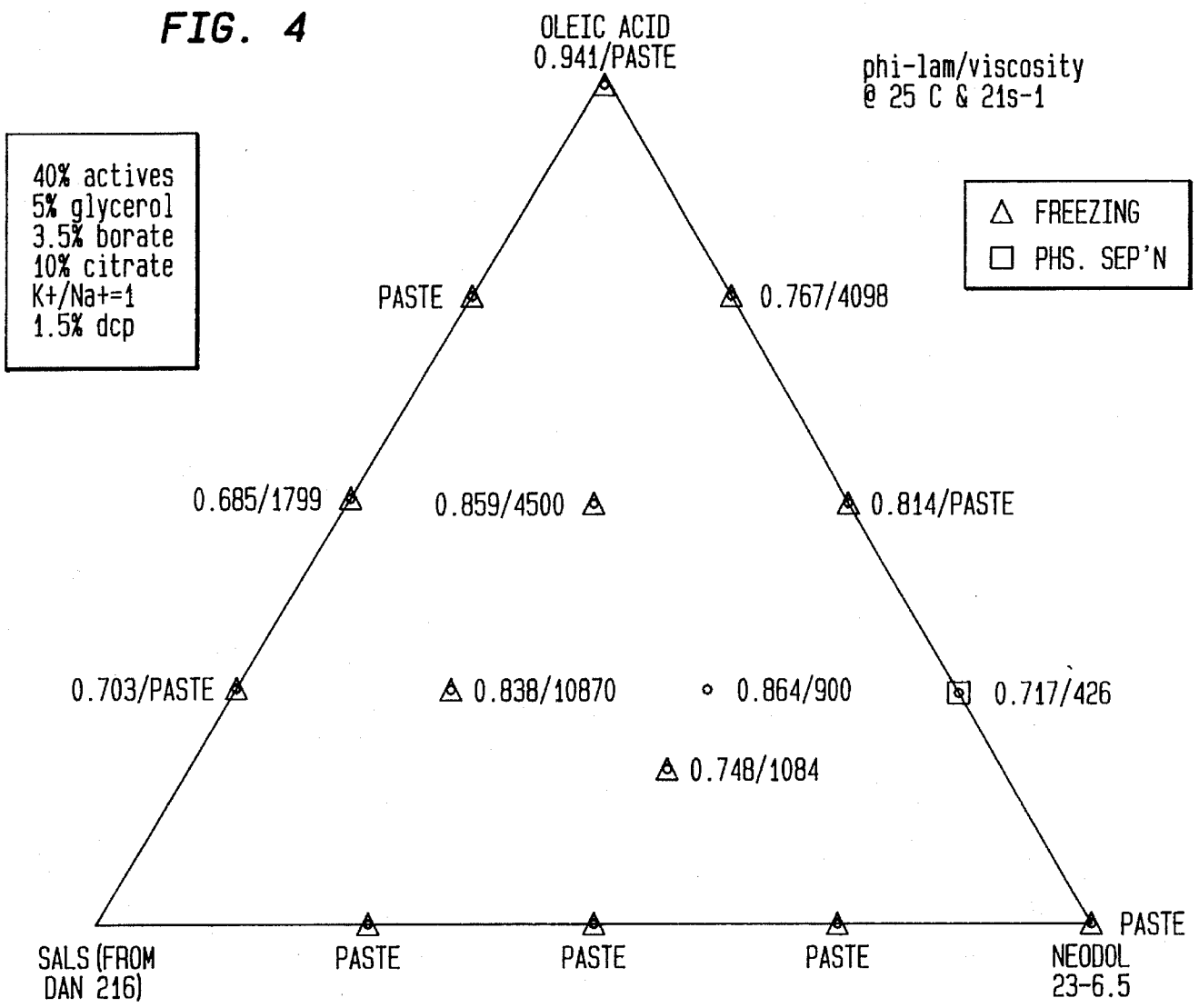
FIG. 4 is ternary active phase diagram for DAN 216 (99% 2 or 3 isomer; outside claimed invention) formulations. This figure clearly shows that these compositions are unstable under cold storage conditions.

Ternary surfactant phase diagrams for formulations containing secondary alcohol sulfates at 62% and 100% 2 & 3 isomer levels are shown in FIGS. 2 and 4. These formulations follow the formulation guidelines in Table 1; more specifically, the formulations contain 5% glycerol, 1.5% deflocculating polymer, and a 1:1 sodium to potassium ratio. Formulation compositions are represented by points on the phase diagrams; beside each point is the viscosity of the formulation at 25° C. and 21 $s^{-1}$, as well as the lamellar volume fraction of each liquid. It is also noted on each phase diagram if phase separation upon storage at 25° C. was evident after two weeks and if freezing occurred during the "temperature-ramp" viscosity procedure listed above.

Because of compositional limitations of the secondary alcohol sulfate available, only part of the phase diagram could be made for the 62% 2 & 3 isomer level. In this diagram, it is evident that oleate levels at or above 20% of total formulation weight cause freezing of the formulation.

Without oleate, two active phases are present or freezing occurs. With moderate amounts of oleate, some electrolyte separation may occur, but this can be remedied by varying electrolyte or decoupling polymer levels.

In Table 3 below, stability data for some of the formulations on this phase diagram are listed:

TABLE 3

DAN 100 Formulation Stability

| Active Comp. (SALS/23-6.5/oleate) | % Phase Sep. 1 Day | % Phase Sep. 1 Week | % Phase Sep. 6 Weeks |
|---|---|---|---|
| 10/20/10 | 0 | 0 | 0 |
| 13/20/7 | 0 | 0 | 2 |
| 17/20/3 | 0 | 1 | 6 |
| 20/20/0 | 5 | 15 | 22 |
| 1.5% DCP | | | |
| Room Temperature | | | |

As can be seen, the addition of oleate decreases the amount of electrolyte phase separation and slows the rate of phase separation.

At the 100% 2 & 3 isomer level, it is evident that freezing occurs at all compositions except one (10% secondary alcohol sulfate, 20% ($C_{12}$–$C_{13}$ alcohol ethoxylate (average EO units 6.5), 10% oleate). This formulation was then refrigerated for two days at 5° C., then its viscosity was measured at this temperature. As was found in Example 1, this liquid forms a thick skin upon cold storage that rendered it unpourable without stirring.

This example demonstrates that there exists upper and lower limits to acceptable oleate levels for these liquids. It also demonstrates that too high a 2 & 3 isomer level precludes making liquids with acceptable cold storage stability.

Example 3

Two compositions of Table 1 containing 10% secondary alcohol sulfate (62% total 2 & 3 isomers), 20% $C_{12}$–$C_{13}$ alcohol ethoxylate (average EO units 6.5), and 10% oleic acid. The sodium to potassium ratio was 1.0. One formulation contained 1.0% deflocculating polymer; the second 1.5% deflocculating polymer. The stabilities of these liquids are shown in Table 4.

TABLE 4

Stability of liquids at different decoupling polymer levels

| % deflocculating polymer | % phase separation after two weeks at room temperature |
|---|---|
| 1.0 | 2.0 |
| 1.5 | 0.0 |

In fact, the formulation containing 1.5% decoupling polymer showed no phase separation after four months' storage at room temperature.

This example demonstrates that a deflocculating polymer level of at least 1.5% gives improved storage stability to secondary alcohol sulfate formulations.

Example 4

Liquids were made according to the specifications of Table 1, containing 10% secondary alcohol sulfate (62% total 2 & 3 isomers), 20% $C_{12}$–$C_{13}$ alcohol ethoxylate (average number of ethylene oxide units 6.5), and 10% oleic acid, at potassium to sodium ratios of 0 and 1. Both formulations were refrigerated for 3 days at 5° C., then their viscosities were measured. The results are shown below in Table 5. The liquid without potassium has unacceptably high viscosity under cold storage conditions.

TABLE 5

Viscosities of liquids at different $K^+$ ratios

| $K^+/Na^+$ ratio | Viscosity @ 5° C. and 21 $s^{-1}$ after 15 minutes (mPas) |
|---|---|
| 0.0 | paste |
| 1.0 | 1000 |

Example 5

Liquids were made with the compositions listed in Table 6. Formulation procedure was similar to that for Examples 1 through 4, except that the formulations were run for 3 minutes through a Gifford-Wood 200WV colloid mill at full power after processing by the technique listed above.

TABLE 6

Formulations containing secondary alcohol sulfates and zeolite

| Ingredient | Formulation A | Formulation B | Formulation C | Formulation D |
|---|---|---|---|---|
| Water | 34.1 | 29.3 | 33.5 | 29.7 |
| Glycerol | 2.1 | 2.1 | 2.1 | 2.1 |
| Sodium Borate. 10 aq | 1.5 | 1.5 | 1.5 | 1.5 |
| Sodium Citrate. 2 aq | 12.8 | 0.0 | 12.8 | 0.0 |
| NaOH, 50% aq. soln. | 2.1 | 0.0 | 2.1 | 0.0 |
| KOH, pellets (87%) | 0.0 | 10.1 | 0.0 | 10.1 |
| Citric Acid, anhyd. | 0.0 | 8.3 | 0.0 | 8.3 |
| Narlex DC-1, 33% | 3.0 | 3.0 | 3.0 | 3.0 |
| Zeolite 4A | 15.0 | 15.0 | 15.0 | 15.0 |
| Secondary alcohol sulfate | 7.5 | 7.5 | 7.5 | 7.5 |
| Neodol 23-6.5 | 15.0 | 15.0 | 15.0 | 15.0 |
| Oleic Acid | 7.5 | 7.5 | 7.5 | 7.5 |
| $K^+/Na^+$ ratio | 0 | 1 | 0 | 1 |
| 2 & 3 isomer level of sec. alc. sulfate | 62% | 62% | 100% | 100% |
| Phase separation after 4 months at room temp. | 0% | 0% | 0% | 5% |
| Viscosity after 15 mins. at 5° C. & 21 $s^{-1}$ | 1600 | 1400 | paste | 800 |

This example indicates that the lower level of 2 & 3 isomers in formulations containing zeolite (A & B versus C & D) help to prevent solidification of formulations under cold storage and give improved storage stability at room temperature as well.

Example 6

Liquids were made with the compositions listed in Table 7. Formulations procedures are the same as those used in Examples 1 through 4 above; sodium carbonate is added with the other species in the electrolyte.

TABLE 7

| Formulations containing secondary alcohol sulfates and zeolite | | | | |
|---|---|---|---|---|
| Ingredient | Formulation A | Formulation B | Formulation C | Formulation D |
| Water | 29.2 | 29.0 | 29.8 | 29.6 |
| Glycerol | 5.0 | 5.0 | 5.0 | 5.0 |
| Sodium Borate. 10 aq | 3.5 | 0.0 | 3.5 | 0.0 |
| Sodium Citrate. 2 aq | 10.0 | 0.0 | 10.0 | 0.0 |
| Sodium Carbonate | 4.0 | 4.0 | 4.0 | 4.0 |
| NaOH, 50% aq. soln. | 2.8 | 0.0 | 2.8 | 0.0 |
| KOH, pellets (87%) | 0.0 | 7.7 | 0.0 | 7.7 |
| Boric Acid | 0.0 | 2.3 | 0.0 | 2.3 |
| Citric Acid, anhyd. | 0.0 | 6.5 | 0.0 | 6.5 |
| Narlex DC-1, 33% | 4.5 | 4.5 | 4.5 | 4.5 |
| Secondary alcohol sulfate | 10.0 | 10.0 | 10.0 | 10.0 |
| Neodol 23-6.5 | 20.0 | 20.0 | 20.0 | 20.0 |
| Oleic Acid | 10.0 | 10.0 | 10.0 | 10.0 |
| 2 & 3 isomer level of sec. alc. sulfate | 62% | 62% | 100% | 100% |
| $K^+/Na^+$ ratio | 1.0 | 0.0 | 1.0 | 0.0 |
| Viscosity after 15 mins. at 5° C. & 21 $s^{-1}$ (mPas) | 1000 | 5000 | paste | paste |

Again, it can be seen that Compositions with lower levels of 2 and 3 isomers (A & B versus C & D) had tolerable viscosities.

I claim:

1. An aqueous surfactant structured liquid composition comprising:

(a) at least 15% by wt. of detergent active material, wherein said material comprises (1) 1 to 30% by wt. of total composition nonionic surfactant; and (2) 1 to 40% by wt. of total composition anionic surfactant, wherein the anionic comprises:

(i) 1 to about 20% by wt. total composition $C_{14}$ to $C_{18}$ mono-unsaturated fatty acid; and (ii) 1 to 20% by wt. total composition secondary alcohol sulfate, wherein the total of 2 or 3 isomers is between about 35% and 85% of the total secondary alcohol sulfate added;

(b) about 1.5% to about 5% deflocculating polymer; and (c) about 1 to 35% by wt. salting-out electrolyte;

wherein the ratio of total potassium ion concentration to total sodium ion concentration is at least about 1.

2. A composition according to claim 1, wherein nonionic is an alkoxylated nonionic.

3. A composition according to claim 2, wherein the alkoxylated nonionic is alcohol ethoxylate or alcohol propoxylate.

4. A composition according to claim 1, wherein monounsaturated fatty acid is selected from the group consisting of oleic acid, palmitoleic acid and mixtures thereof.

5. A composition according to claim 1, wherein the salting out electrolyte is selected from the group consisting of citrate, carbonate, sulfate and mixtures thereof.

6. A composition according to claim 1, additionally comprising 1 to 25% by wt. zeolite.

* * * * *